US009128418B2

(12) United States Patent
Okuma et al.

(10) Patent No.: US 9,128,418 B2
(45) Date of Patent: Sep. 8, 2015

(54) DEVELOPING DEVICE AND IMAGE FORMING APPARATUS

(71) Applicant: FUJI XEROX CO., LTD., Tokyo (JP)

(72) Inventors: Hiroaki Okuma, Kanagawa (JP); Toshiaki Suzuki, Kanagawa (JP); Yasutomo Ishii, Kanagawa (JP); Kiyohito Horii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/200,883

(22) Filed: Mar. 7, 2014

(65) Prior Publication Data

US 2015/0010323 A1 Jan. 8, 2015

(30) Foreign Application Priority Data

Jul. 8, 2013 (JP) ..... 2013-142787

(51) Int. Cl.
*G03G 15/08* (2006.01)
*G03G 15/09* (2006.01)

(52) U.S. Cl.
CPC ..... *G03G 15/0942* (2013.01); *G03G 15/0928* (2013.01)

(58) Field of Classification Search
CPC ..... G03G 15/0896; G03G 21/206; G03G 15/0942; G03G 15/0928
USPC ..... 399/104
See application file for complete search history.

(56) References Cited

U.S. PATENT DOCUMENTS

2013/0108310 A1* 5/2013 Hirakawa et al. ..... 399/92

FOREIGN PATENT DOCUMENTS

| | | |
|---|---|---|
| JP | A-2005-242194 | 9/2005 |
| JP | A-2007-24984 | 2/2007 |
| JP | A-2012-103282 | 5/2012 |

* cited by examiner

*Primary Examiner* — David Bolduc
*Assistant Examiner* — Barnabas Fekete
(74) *Attorney, Agent, or Firm* — Oliff PLC

(57) ABSTRACT

A developing device includes a developer carrier that has a cylindrical shape and that rotates while holding developer to supply the developer to an image carrier on which an electrostatic latent image is formed; a container that contains the developer carrier; a discharge-path forming member that forms a discharge path along which air is discharged out of the container from inside the container; and a magnetic member that generates a magnetic field that acts on the developer in the discharge path and causes the developer to stay in the discharge path.

10 Claims, 5 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2013-142787 filed Jul. 8, 2013.

BACKGROUND

Technical Field

The present invention relates to a developing device and an image forming apparatus.

SUMMARY

According to an aspect of the invention, a developing device includes a developer carrier that has a cylindrical shape and that rotates while holding developer to supply the developer to an image carrier on which an electrostatic latent image is formed; a container that contains the developer carrier; a discharge-path forming member that forms a discharge path along which air is discharged out of the container from inside the container; and a magnetic member that generates a magnetic field that acts on the developer in the discharge path and causes the developer to stay in the discharge path.

BRIEF DESCRIPTION OF THE DRAWINGS

An exemplary embodiment of the present invention will be described in detail based on the following figures, wherein.

DETAILED DESCRIPTION

1. Exemplary Embodiment 1-1. Overall Structure of Image Forming Apparatus

Figure 1:
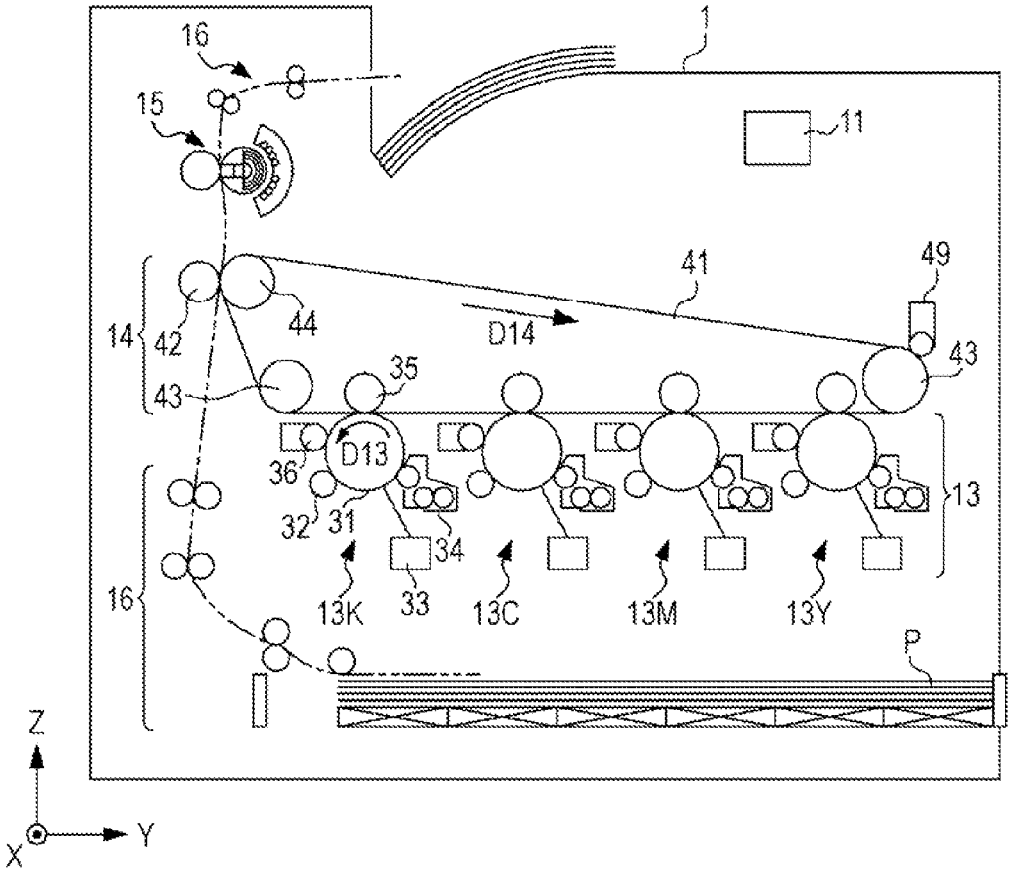
FIG. 1 illustrates the overall structure of an image forming apparatus according to an exemplary embodiment of the present invention.

FIG. 1 illustrates the overall structure of an image forming apparatus 1 according to an exemplary embodiment of the present invention. In the following description, to describe the arrangement of components of the image forming apparatus 1, the space in which the components are arranged is represented by an xyz right-handed coordinate system. Of the symbols of the coordinate system illustrated in each figure, the white circle with a black dot therein represents an arrow in the direction from the far side to the near side in the figure. In the space, the direction along the x-axis is referred to as an x-axis direction. In the x-axis direction, the direction in which the x component increases is referred to as a +x direction, and the direction in which the x component decreases is referred to as a −x direction. Similarly, a y-axis direction, a +y direction, a −y direction, a z-axis direction, a +z direction, and a −z direction are defined for the y and z components.

As illustrated in FIG. 1, the image forming apparatus 1 includes a controller 11, developing units 13Y, 13M, 13C, and 13K, a transfer unit 14, a fixing unit 15, and a transport unit 16. The letters Y, M, C, and K appended to the reference numeral 13 respectively represent yellow, magenta, cyan, and black toners. The developing units 13Y, 13M, 13C, and 13K basically have similar structures except for the color of the toner contained therein. When it is not necessary to distinguish the developing units 13Y, 13M, 13C, and 13K from each other, the developing units will be referred to simply as "developing units 13" without the letters representing the toner colors appended at the end.

The controller 11 includes a storage unit such as a central processing unit (CPU), a read only memory (ROM), a random access memory (PAM), a solid state drive, or a hard disc drive. The CPU reads computer programs stored in the storage unit and executes the programs to control each part of the image forming apparatus 1.

The transport unit 16 includes a container and transport rollers. The container contains sheets of paper P that are cut into a predetermined size in advance and that serve as media. The sheets of paper P contained in the container are fed one at a time by the transport rollers and transported to the transfer unit 14 along a sheet transport path in accordance with an instruction of the controller 11. The media are not limited to sheets of paper, and may instead be, for example, resin sheets. The media are not particularly limited as long as images may be recorded on the surfaces thereof.

Each developing unit 13 includes an image carrier 31, a charging device 32, an exposure device 33, a developing device 34, a first transfer roller 35, and a drum cleaner 36. The image carrier 31 is a photoconductor drum that includes a charge generating layer and a charge transport layer, and is rotated in the direction of arrow D13 in FIG. 1 by a drive unit (not shown). The charging device 32 charges the surface of the image carrier 31. The exposure device 33 includes a laser source and a polygonal mirror (neither is shown). The exposure device 33 is controlled by the controller 11 so as to emit a laser beam corresponding to image data toward the image carrier 31 that has been charged by the charging device 32. Thus, an electrostatic latent image is formed on the image carrier 31. The controller 11 may receive the above-described image data from an external device through a communication unit (not shown). The external device may be, for example, a reading device capable of reading an original image or a storage device that stores data representing an image. The developing device 34 supplies developer to the image carrier 31. Thus, an image is formed (developed) on the image carrier 31.

The first transfer roller 35 generates a predetermined potential difference between the image carrier 31 and an intermediate transfer belt 41 included in the transfer unit 14 at a position where the image carrier 31 faces the intermediate transfer belt 41. Owing to the potential difference, the image is transferred onto the intermediate transfer belt 41. The drum cleaner 36 removes the toner that has not been transferred and that remains on the surface of the image carrier 31 after the transferring of the image, and also removes the electricity from the surface of the image carrier 31.

The transfer unit 14 includes the intermediate transfer belt 41, a second transfer roller 42, belt transfer rollers 43, a back-up roller 44, and a belt cleaner 49. The transfer unit 14 transfers the images formed by the developing units 13 onto a sheet of paper P. The intermediate transfer belt 41 is an endless belt member and is wrapped around the belt transfer rollers 43 and the back-up roller 44. At least one of the belt transfer rollers 43 and the back-up roller 44 is provided with a drive unit (not shown) that rotates the intermediate transfer belt 41 in the direction of arrow D14 in FIG. 1. One or more of the belt transfer rollers 43 and the back-up roller 44 that have no drive unit are rotated by the rotation of the intermediate transfer belt 41. When the intermediate transfer belt 41 is rotated in the direction of arrow D14 in FIG. 1, the images on the intermediate transfer belt 41 are moved to the region between the second transfer roller 42 and the back-up roller 44.

Owing to a potential difference between the second transfer roller 42 and the intermediate transfer belt 41, the images on the intermediate transfer belt 41 are transferred onto the sheet of paper P that has been transported by the transport unit 16. The belt cleaner 49 removes toner that has not been transferred and that remains on the surface of the intermediate transfer belt 41. The transfer unit 14 or the transport unit 16 transports the sheet of paper P onto which the images have been transferred to the fixing unit 15. The fixing unit 15 fixes the images that have been transferred onto the sheet of paper P by applying heat thereto.

1-2. Structure of Developing Device

Figure 2:
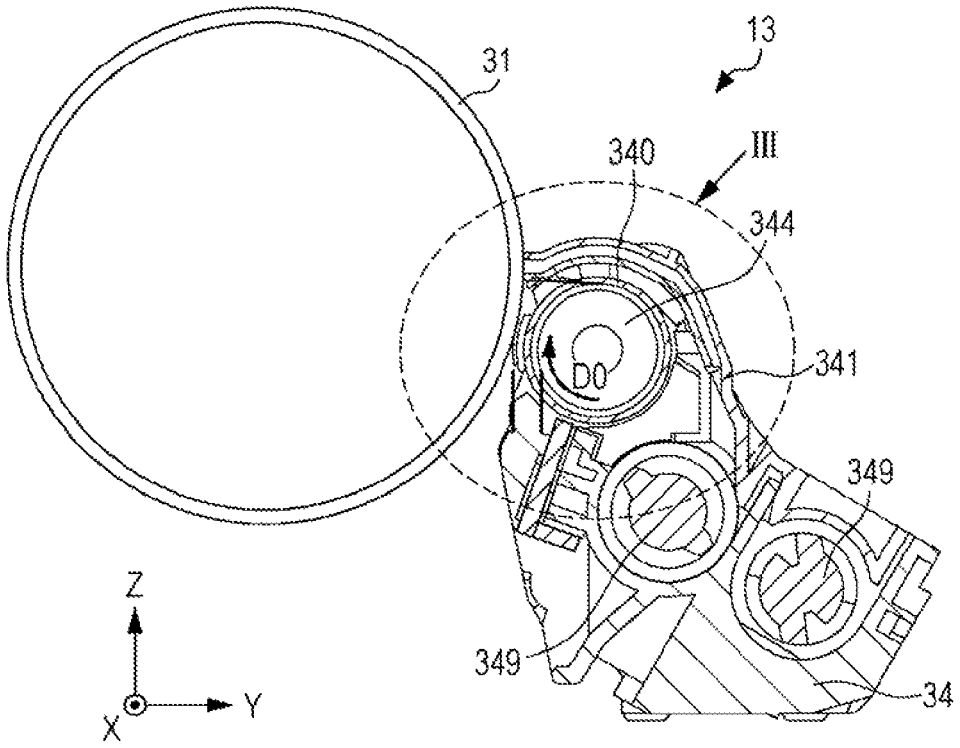
FIG. 2 illustrates the structure of a developing device.
Figure 3:
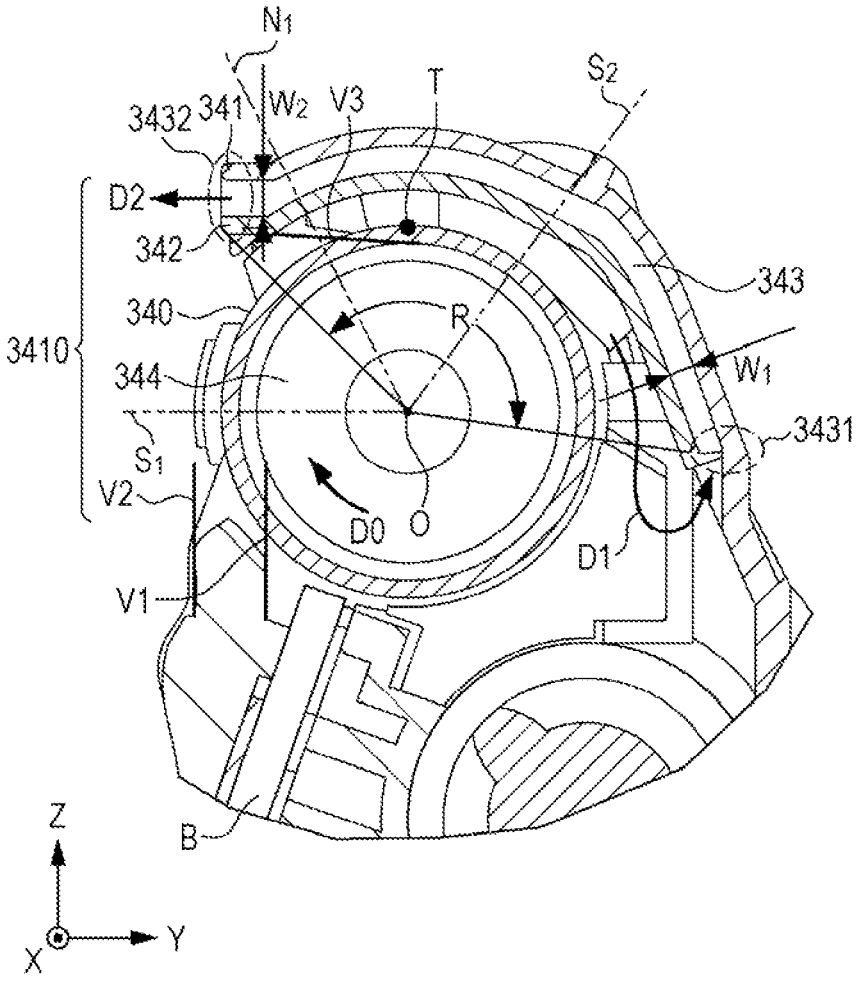
FIG. 3 is an enlarged view of part II in FIG. 2.

FIG. 2 illustrates the structure of the developing device 34. FIG. 3 is an enlarged view of part III shown in FIG. 2. As illustrated in FIG. 2, the developing device 34 is below and at the +y-direction side of the outer peripheral surface of the image carrier 31, and includes a developer carrier 340, a magnet roller 344, and two screws 349. As illustrated in FIG. 3, the developing device 34 further includes a container 341 and a discharge-path forming member 342.

The container 341 contains two-component developer containing Y, M, C, or K toner and magnetic carrier such as ferrite powder. The container 341 also contains the developer carrier 340, the magnet roller 344, and the two screws 349. The container 341 has an opening 3410 that faces the image carrier 31.

The magnet roller 344 is a columnar member which serves as a magnetic-field generator that generates a predetermined magnetic field around a side surface thereof with magnetic members, such as permanent magnets, fixed therein. The magnetic field generated by the magnetic members fixed in the magnet roller 344 acts on the developer so that the developer is prevented from being discharged out of the container 341. The developer carrier 340 is a so-called developing sleeve which rotates around the magnet roller 344 while holding the developer on the outer peripheral surface thereof, thereby supplying the developer to the image carrier 31 having an electrostatic latent image formed thereon. The developer carrier 340 is arranged so as to face the image carrier 31 in the opening 3410 of the container 341. The magnet roller 344 is fixed in the developer carrier 340, and forms plural magnetic poles that extend along an axial direction at predetermined angular positions. When the developer carrier 340 passes the location of each magnetic pole of the magnet roller 344, the developer on the developer carrier 340 receives a magnetic force.

As illustrated in FIG. 3, the magnetic poles of the magnet roller 344 include a first pole $S_1$, a transport pole $N_1$, and a separation pole $S_2$. The first pole $S_1$ is an S pole for forming a magnetic brush that projects toward the image carrier 31 to supply the developer to the image carrier 31. The transport pole $N_1$ is an N pole for transporting the magnetic brush into the container 341 after the supply of the developer is performed. The separation pole $S_2$ is an S pole for separating the magnetic brush that has been transported into the container 341 from the surface of the developer carrier 340 and returning the magnetic brush to a stirring region in which the screws 349 perform stirring.

The developer carrier 340 is a nonmagnetic cylindrical member that covers the outer peripheral surface of the magnet roller 344. The developer carrier 340 rotates when a voltage is applied thereto. When the developer carrier 340 is rotated by a drive unit (not shown) in the direction of arrow D0 shown in FIG. 2, the developer, which receives a magnetic force from the magnet roller 344, is transported in the direction of arrow D0.

The two screws 349 supply the developer to the developer carrier 340 while stirring the developer. Owing to the magnetic force applied by the magnet roller 344, the developer supplied to the developer carrier 340 forms a magnetic brush having bristles that extend along magnetic lines of force. The thus-formed magnetic brush is retained by the developer carrier 340, and is moved by the rotation of the developer carrier 340 to a position where the magnetic brush faces the image carrier 31. When the tips of the bristles come into contact with the surface of the image carrier 31, the toner adheres to portions of the surface of the image carrier 31 that have been exposed to light by the exposure device 33, that is, to image portions of the electrostatic latent image. Thus, an image is formed on the image carrier 31.

The discharge-path forming member 342 extends in the rotational axis direction of the developer carrier 340 along the outer peripheral surface of the developer carrier 340. The discharge-path forming member 342 covers a portion of the developer carrier 340 and forms a discharge path 343, through which the air is discharged out of the container 341, between itself and the inner wall of the container 341. The discharge-path forming member 342 is supported in the container 341 by ribs (not shown) provided on portions of the inner wall surface of the container 341. The discharge-path forming member 342 covers a top portion T of a path along which the outer peripheral surface of the developer carrier 340 moves, the top portion T being located at the uppermost position of the path. An outlet 3432 of the discharge path 343 is closer to the image carrier 31 than the top portion T.

A valve V1 and a valve V2 are provided at the bottom side of the opening in the container 341. The valve V1 is in contact with the developer carrier 340 at an angle such that the distance between the valve V1 and the surface of the developer carrier 340 decreases as the developer carrier 340 rotates further in the direction of arrow D0. The valve V1 regulates the flow of air so that the developer is not easily blown toward the image carrier 31 through a gap between the developer carrier 340 and the bottom side of the opening. The valve V2 is in contact with the image carrier 31 so that the developer is prevented from being diffused.

A layer regulating member B, which is a member called, for example, a trimmer bar, comes into contact with the magnetic brush formed on the surface of the developer carrier 340 that rotates in the direction of arrow D0, and scrapes off part of the magnetic brush so that the height of the magnetic brush is adjusted to a predetermined height. The developer that has been scraped off returns to the screws 349. After the height of the magnetic brush is adjusted, the magnetic brush passes through the position where it faces the image carrier 31, supplies the toner to the surface of the image carrier 31, and moves to a region R covered by the discharge-path forming member 342.

The discharge-path forming member 342 is provided with a valve V3. The valve V3 is in contact with the developer carrier 340 at an angle such that the distance between the valve V3 and the surface of the developer carrier 340 decreases as the developer carrier 340 rotates further in the direction of arrow D0. The valve V3 regulates the flow of air so that the developer is not easily blown toward the image carrier 31 through a gap between the developer carrier 340 and the top side of the opening.

Thus, owing to the valve V and the valve V3, the air in the container 341 does not easily flow toward the image carrier 31 through the opening 3410. Since the magnetic brush that passes the valve V3 and reaches the top portion T moves into the container 341 together with the air, the inner pressure of the container 341 increases.

As illustrated in FIG. 3, for example, the discharge-path forming member 342 covers the region R that extends over a quarter or more of the entire outer peripheral surface of the developer carrier 340 and that includes a portion located at the top portion T. The magnetic brush having a height adjusted by the layer regulating member B is formed on the developer carrier 340 when the developer holder 340 reaches the region R. The discharge-path forming member 342 is spaced from the developer carrier 340 so that the discharge-path forming member 342 does not come into contact with the magnetic brush. In this case, compared to the case in which the discharge-path forming member 342 comes into contact with the magnetic brush and breaks the magnetic brush, an amount of developer that floats in the container 341 may be reduced.

The air in the container 341 flows in the direction of arrow D1 shown in FIG. 3 and enters the discharge path 343 through an inlet 3431. Since the discharge path 343 extends toward the image carrier 31, the air that has entered through the inlet 3431 is discharged through the outlet 3432 toward the image carrier 31 in the direction of arrow D2. Thus, the increase in the inner pressure of the container 341 is suppressed.

The relationship between the magnetic poles generated by the magnet roller 344 and the discharge path 343 will now be described. When, for example, the developing device 34 is detached from the image forming apparatus 1 and tilted, there is a possibility that the developer contained in the container 341 will enter the discharge path 343 through the inlet 3431. As illustrated in FIG. 3, the discharge path 343 is located so as to cross the magnetic lines of force that extend from the transport pole $N_1$ and the separation pole $S_2$ generated by the magnet roller 344, and so that the discharge path 343 is within a range in which the magnetic fields generated by the transport pole $N_1$ and the separation pole $S_2$ exert an attractive force. Therefore, even when the developer enters the discharge path 343, the magnetic carrier contained in the developer is affected by the magnetic lines of force that extend from the transport pole $N_1$ and the separation pole $S_2$ at the positions where the magnetic lines of force cross the discharge path 343. In other words, the magnetic members disposed in the magnet roller 344 generate the magnetic fields that act on the developer in the discharge path 343, so that the developer is kept in the discharge path 343. Thus, the magnetic carrier is confined in the discharge path 343.

In the present exemplary embodiment, the magnetic fields that attract the developer toward the magnet roller 344 extend to the inner wall surface of the container 341. In other words, the magnetic members provided in the magnet roller 344 generate the magnetic fields in the discharge path 343, the magnetic fields being capable of retaining the developer that is in contact with the inner wall surface of the container 341. Therefore, even when a large amount of developer enters the discharge path 343, magnetic brushes are formed which extend to a height such that the magnetic brushes contact the inner wall surface of the container 341 at positions corresponding to the transport pole $N_1$ and the separation pole $S_2$ in the discharge path 343. As a result, the possibility that the developer that has entered the discharge path 343 will be discharged out of the developing device 34 through the outlet 3432 is reduced.

As described above, in the developing device 34, the discharge path 343 is arranged so as to cross the magnetic lines of force that extend from the separation pole $S_2$ and the like generated by the magnet roller 344. Thus, the possibility that the developer will be discharged to the outside through the discharge path 343 for discharging the air out of the container 341 is reduced.

Referring to FIG. 3, the discharge path 343 may be formed such that the gap $W_2$ of the outlet 3432 is greater than the gap $W_1$ of the inlet 3431. Here, the "gap" of the discharge path 343 is the dimension of the discharge path 343 along the radial lines extending from the rotational axis O of the developer carrier 340 toward the outer peripheral surface of the developer carrier 340. In the case where the lengths of the outlet 3432 and the inlet 3431 are both the same as of that of the developer carrier 340 in the axial direction, the outlet 3432, which has a larger gap, has a larger cross section than the inlet 3431. Namely, the cross section of the outlet 3432 through which the air is discharged from the discharge path 343 is larger than the cross section of the inlet 3431 through which the air enters the discharge path 343. As a result, the velocity at which the air passes through the outlet 3432 is lower than the velocity at which the air passes through the inlet 3431, and the possibility that the developer will be discharged from the discharge path 343 by the air may be further reduced.

Since the air containing the developer tends to stay around the image carrier 31, a cloud processing device that sucks the air that stays around the image carrier 31 is commonly arranged near the image carrier 31. As described above, the discharge path 343 extends toward the image carrier 31. Therefore, in the case where the cloud processing device is provided, the air in the container 341 of the developing device 34 may be processed by the cloud processing device even when no additional processing device is provided.

The discharge path 343 extends along the outer peripheral surface of the developer carrier 340, and covers the top portion T of the path along which the outer peripheral surface moves, the top portion T being located at the uppermost position of the path. Therefore, the air that flows into the discharge path 343 through the inlet 3431 flows against the gravity until the air passes the top portion T. Accordingly, the developer contained in the air may be easily removed due to gravity before the air passes the top portion T, and the possibility that the toner contained in the discharged air will stain the medium or the like may be reduced.

2. Modifications

Although an exemplary embodiment has been described above, the exemplary embodiment may be modified as follows.

The modifications described below may be employed in combination.

2-1. First Modification

In the above-described exemplary embodiment, the discharge path 343 extends toward the image carrier 31. However, it is not necessary that the discharge path 343 extend toward the image carrier 31 as long as the discharge path 343 is closer to the image carrier 31 than the top portion T.

Figure 4:
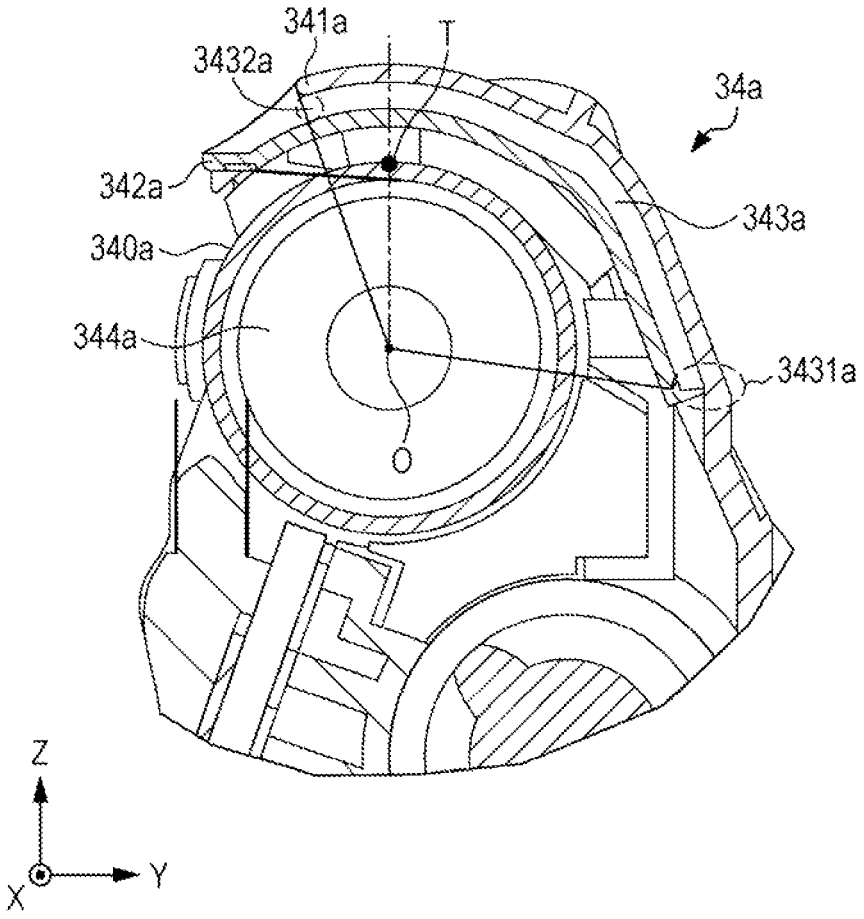
FIG. 4 illustrates the shape of a discharge path according to a modification.

FIG. 4 illustrates the shape of a discharge path 343*a* according to this modification. In this modification, a developing device 34*a* includes a developer carrier 340*a*, a magnet roller 344*a*, a container 341*a*, and a discharge-path forming member 342*a*. The developing device 34*a* differs from the above-described developing device 34 in that an image-carrier-31-side end portion (the image carrier 31 is not illustrated in FIG. 4) of a part of the container 341*a* that covers the developer carrier 340*a* from above is farther from the image carrier 31 than an image-carrier-31-side end portion of the discharge-path forming member 342*a*. Therefore, an outlet

3432*a* of the discharge path 343*a* does not face the image carrier 31. However, as illustrated in FIG. 4, the above-described image-carrier-31-side end portions of the container 341*a* and the discharge-path forming member 342*a* are both closer to the image carrier 31 than the top portion T. As a result, also in this modification, the outlet 3432*a* is closer to the image carrier 31 than the top portion T. Therefore, in the case where the above-described cloud processing device is arranged near the image carrier 31, the air in the container 341*a* of the developing device 34*a* may be processed by the cloud processing device even when no additional processing device is provided.

2-2. Second Modification

In the above-described exemplary embodiment, the discharge-path forming member 342 covers a region that extends over a quarter or more of the entire outer peripheral surface of the developer carrier 340 and that includes a portion located at the top portion T. However, it is not necessary that the region covered by the discharge-path forming member 342 extend over a quarter or more of the entire circumference of the developer carrier 340 as long as, for example, the inlet 3431 through which the air enters the discharge path 343 is below the rotational axis O of the developer carrier 340.

2-3. Third Modification

In the above-described exemplary embodiment, the discharge-path forming member 342 forms the discharge path 343 such that the discharge path 343 extends along the outer peripheral surface of the developer carrier 340 and covers a portion of the developer carrier 340. However, it is not necessary that the discharge path 343 extend along the outer peripheral surface of the developer carrier 340.

In addition, although the magnetic members, such as permanent magnets, that prevent the developer from being discharged out of the container 341 are disposed in the magnet roller 344, the magnetic members may instead be disposed outside the magnet roller 344. The magnetic members are not limited to permanent magnets. The magnetic members may instead be electromagnets as long as the developer may be prevented from being discharged out of the container 341.

Figure 5A:
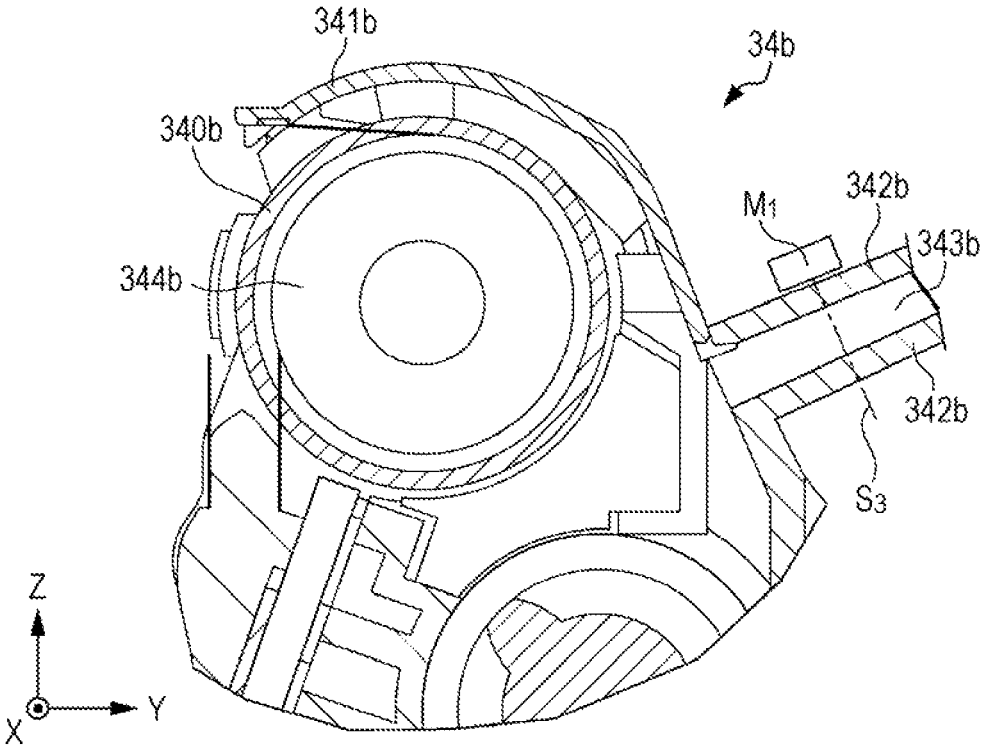
FIGS. 5A and 5B illustrate the arrangements of magnetic members according to another modification.
Figure 5B:
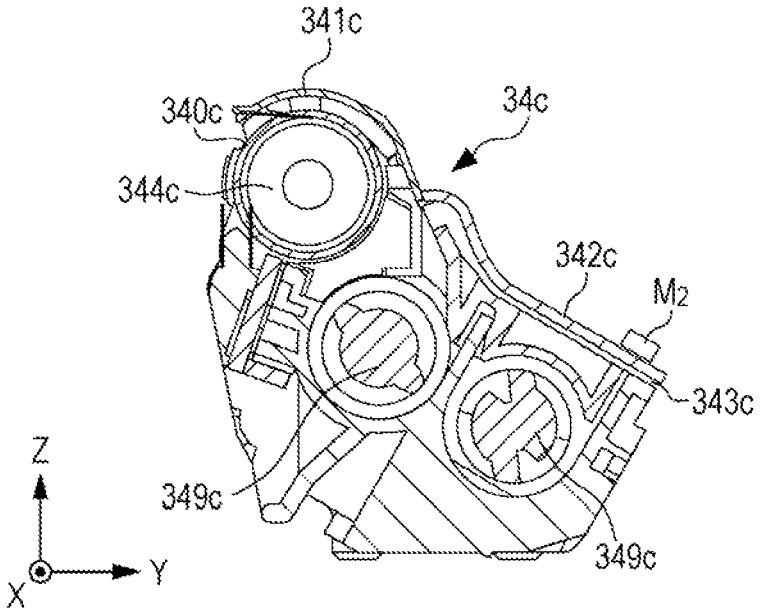

FIGS. 5A and 5B illustrate the arrangements of magnetic members in such a modification. FIG. 5A illustrates a discharge-path forming member 342*b* that forms a discharge path 343*b* and a magnetic member $M_1$ provided along the discharge path 343*b*. Hereinafter, components of a developing device 34*b* according to this modification are denoted by reference symbols obtained by adding the letter 'b' to the reference symbols of the corresponding components of the developing device 34 according to the above-described exemplary embodiment.

The discharge-path forming member 342*b* illustrated in FIG. 5A is provided at an opening formed in a housing of a container 341*b*, the opening being further toward the +y-direction side than a developer carrier 340*b*. The discharge-path forming member 342*b* extends in the +y direction from the edge of the opening. The discharge path 343*b*, which is formed by the discharge-path forming member 342*b*, also extends in the +y direction. In this case, it is not necessary that the discharge path 343*b* be formed between the discharge-path forming member 342*b* and the inner wall surface of the container 341*b*. As illustrated in FIG. 5A, the magnetic member $M_1$ is provided along the discharge path 343*b*, and generates a magnetic pole $S_3$ toward the discharge path 343*b*. The magnetic field generated by the magnetic pole $S_3$ acts on the developer in the discharge path 343*b* so that the developer is prevented from being discharged out of the container 341*b*.

In the above-described exemplary embodiment, the discharge-path forming member 342 covers the top portion T of the path along which the outer peripheral surface of the developer carrier 340 moves, the top portion T being located at the uppermost position of the path, and the outlet 3432 of the discharge path 343 is located closer to the image carrier 31 than the top portion T. However, the arrangement of the discharge path and the outlet is not limited to this. FIG. 5B illustrates a developing device 34*c* in which a discharge-path forming member 342*c* forms a discharge path 343*c* that extends along the outer wall of a housing of a container 341*c*. Hereinafter, components of the developing device 34*c* according to this modification are denoted by reference symbols obtained by adding the letter 'c' to the reference symbols of the corresponding components of the developing device 34 according to the above-described exemplary embodiment.

The container 341*c* contains a developer carrier 340*c* and two screws 349*c*. The two screw 349*c* are located further toward the −z-direction side and +y-direction side than the developer carrier 340*c*, and the housing of the container 341*c* is shaped so as to extend along the screws 349*c*. The housing of the container 341*c* has an opening at the +y-direction side of the developer carrier 340, and the discharge-path forming member 342*c* extends from the opening along the outer wall of the housing of the container 341*c*. The discharge-path forming member 342*c* and the outer wall surface of the housing of the container 341*c* form the discharge path 343*c*. As illustrated in FIG. 5B, a magnetic member $M_2$ is provided along the discharge path 343*c*, and the magnetic field generated by the magnetic member Ms acts on the developer in the discharge path 343*c* so that the developer is prevented from being discharged out of the container 341*c*.

In this modification, the inner wall surface of the housing of the container 341*c* may be formed so that the inner wall surface does not come into contact with the magnetic brush held by the developer carrier 340*c*. In this case, compared to the case in which the inner wall surface of the housing of the container 341*c* comes into contact with the magnetic brush and breaks the magnetic brush, an amount of developer that floats in the container 341*c* may be reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that has a cylindrical shape and that rotates while holding developer to supply the developer to an image carrier on which an electrostatic latent image is formed;

a container that contains the developer carrier;

a discharge-path forming member that forms a discharge path along which air is discharged out of the container from inside the container; and a magnetic member that generates a magnetic field that acts on the developer in the discharge path and causes the developer to stay in the discharge path, wherein one side of the discharge-path forming member forms the discharge path and another side of the discharge-path forming member forms an area through which the developer held by the developer carrier passes, the discharge path being an elongate channel in which the air flows in a direction substantially the same as a direction of flow of the developer held by the developer carrier in the area formed by the other side of the discharge-path forming member.

2. The developing device according to claim 1, wherein the discharge path is formed along an outer peripheral surface of the developer carrier, and wherein the magnetic member is disposed in the developer carrier.

3. The developing device according to claim 1, wherein the discharge-path forming member forms the discharge path together with an inner wall surface of the container, and wherein the magnetic field generated by the magnetic member is capable of retaining the developer that is in contact with the inner wall surface in the discharge path.

4. The developing device according to claim 1, wherein the discharge-path forming member covers a top portion of a path along which an outer peripheral surface of the developer carrier moves, the top portion being located at an uppermost position of the path, and an outlet of the discharge path is located closer to the image carrier than the top portion.

5. The developing device according to claim 1, wherein the discharge path extends toward the image carrier.

6. The developing device according to claim 1, wherein the discharge path covers a quarter or more of an outer peripheral surface of the developer carrier.

7. A developing device comprising:

a developer carrier that has a cylindrical shape and that rotates while holding developer to supply the developer to an image carrier on which an electrostatic latent image is formed;

a container that contains the developer carrier;

a discharge-path forming member that forms a discharge path along which air is discharged out of the container from inside the container; and a magnetic member that generates a magnetic field that acts on the developer in the discharge path and causes the developer to stay in the discharge path, wherein an inlet through which the air enters the discharge path is located below a rotational axis of the developer carrier.

8. A developing device comprising:

a developer carrier that has a cylindrical shape and that rotates while holding developer to supply the developer to an image carrier on which an electrostatic latent image is formed;

a container that contains the developer carrier;

a discharge member that forms a discharge path along which air is discharged out of the container from inside the container; and a magnetic member that generates a magnetic field that acts on the developer in the discharge path and causes the developer to stay in the discharge path, wherein a cross section of an outlet through which the air is discharged from the discharge path is larger than a cross section of an inlet through which the air enters the discharge path.

9. The developing device according to claim 3, wherein the developer carried by the developer carrier does not contact a surface of the discharge-path forming member, the surface facing the developer carrier.

10. An image forming apparatus comprising:

the developing device according to claim 1;

the image carrier that carries the electrostatic latent image and receives the developer from the developing device; and a transfer unit that transfers an image from the image carrier onto a medium, the image being developed by the developer supplied from the developing device.

* * * * *